US008733566B2

(12) United States Patent
Druitt et al.

(10) Patent No.: US 8,733,566 B2
(45) Date of Patent: May 27, 2014

(54) TAMPER EVIDENCE MEANS FOR A CLOSURE AND A TAMPER EVIDENT CLOSURE

(75) Inventors: Rod Druitt, Bath and South East Somerset (GB); Louis Lagler, Zürich (CH)

(73) Assignee: Creanova Universal Closures, Ltd. (GB)

( * ) Notice: Subject to any disclaimer, the term of this patent is extended or adjusted under 35 U.S.C. 154(b) by 1425 days.

(21) Appl. No.: 11/574,567

(22) PCT Filed: Sep. 1, 2005

(86) PCT No.: PCT/EP2005/054307

§ 371 (c)(1), (2), (4) Date: Oct. 16, 2007

(87) PCT Pub. No.: WO2006/024656

PCT Pub. Date: Mar. 9, 2006

(65) Prior Publication Data

US 2008/0169261 A1 Jul. 17, 2008

Related U.S. Application Data

(60) Provisional application No. 60/606,240, filed on Sep. 1, 2004, provisional application No. 60/655,324, filed on Feb. 23, 2005.

(30) Foreign Application Priority Data

Apr. 8, 2005 (EP) ..... PCT/EP2005/051575

(51) Int. Cl.
*B65D 41/34* (2006.01)
*B65D 43/16* (2006.01)

(52) U.S. Cl.
USPC ..... 215/253; 215/237; 220/835; 220/326; 222/556

(58) Field of Classification Search
USPC ..... 215/235, 237, 253, 254, 255, 256; 220/254.3, 254.5, 833, 834, 835, 326; 222/525, 556
See application file for complete search history.

(56) References Cited

U.S. PATENT DOCUMENTS

| | | | | |
|---|---|---|---|---|
| 4,838,441 | A * | 6/1989 | Chernack | 215/216 |
| 5,148,912 | A * | 9/1992 | Nozawa | 220/838 |
| 5,305,900 | A | 4/1994 | Maguire et al. | 215/245 |
| 5,386,918 | A | 2/1995 | Neveras et al. | |

(Continued)

FOREIGN PATENT DOCUMENTS

| | | |
|---|---|---|
| EP | 0151242 | 8/1985 |
| EP | 0515348 | 11/1992 |

(Continued)

OTHER PUBLICATIONS

International Search Report PCT/EP2005/054307 dated Dec. 2, 2005 (European Patent Office).

*Primary Examiner* — Anthony Stashick
*Assistant Examiner* — James N Smalley
(74) *Attorney, Agent, or Firm* — Ostrolenk Faber LLP

(57) ABSTRACT

The invention concerns a tamper evidence and locking means for a closure and a tamper evident closure. The tamper evidence and locking means indicate initial opening and allow relocking the closure after initial opening.

17 Claims, 7 Drawing Sheets

(56) References Cited

U.S. PATENT DOCUMENTS

| | | | | |
|---|---|---|---|---|
| 5,603,436 | A * | 2/1997 | Leoncavallo et al. | 222/525 |
| 5,634,060 | A | 5/1997 | Jennings | |
| 5,735,419 | A * | 4/1998 | Ma | 215/253 |
| 5,853,093 | A * | 12/1998 | Neiger | 215/237 |
| 5,875,907 | A | 3/1999 | Lay | 215/253 |
| 6,234,334 | B1 * | 5/2001 | Suarez | 215/237 |
| 6,296,986 | B1 | 10/2001 | Illsley et al. | |
| 6,347,716 | B1 | 2/2002 | Nofer et al. | |
| 6,405,885 | B1 | 6/2002 | Elliott | |
| 6,550,626 | B1 | 4/2003 | Randall | |
| 6,634,060 | B1 | 10/2003 | Lagler et al. | |
| 2001/0032827 | A1 | 10/2001 | Montgomery et al. | 215/235 |
| 2003/0034323 | A1 | 2/2003 | Smith et al. | |
| 2003/0062369 | A1 | 4/2003 | Hierzer et al. | |
| 2004/0069806 | A1 * | 4/2004 | Benoit-Gonin et al. | 222/153.06 |
| 2004/0188374 | A1 | 9/2004 | Ochoa Laburu | |

FOREIGN PATENT DOCUMENTS

| | | |
|---|---|---|
| EP | 0621199 | 10/1994 |
| EP | 0746512 | 8/1998 |
| EP | 0836576 | 9/1999 |
| EP | 1075432 | 9/2002 |
| FR | 2802182 | 6/2001 |
| WO | WO 01/46032 | 6/2001 |
| WO | WO 02/060776 | 8/2002 |
| WO | WO 03/026981 | 4/2003 |
| WO | WO 03/086891 | 10/2003 |

* cited by examiner

TAMPER EVIDENCE MEANS FOR A CLOSURE AND A TAMPER EVIDENT CLOSURE

CROSS REFERENCE TO RELATED APPLICATION

The present application is a 35 U.S.C. §371 national phase conversion of PCT/EP2005/054307 filed 1 Sep. 2005, which claims priority of U.S. Provisional Patent Application No. 60/606,240 filed 1 Sep. 2004, U.S. Provisional Patent Application No. 60/655,324 filed 23 Feb. 2005 and PCT/EP2005/051575 filed 8 Apr. 2005, which are herein incorporated by reference. The PCT International Application was published in the English Language.

BACKGROUND OF THE INVENTION

1. Field of the Invention

The invention relates to a tamper evidence means for a closure, respectively to a tamper evident closure. In particular the invention provides a hinged tamper evident cap for glass or PET containers with contents such as beverages at, above or below atmospheric pressure or having gaseous components.

2. Description of the Art

Various hinged closures for drinks packages are known from prior art which comprise features foreseen to indicate initial opening. Those tamper-evident means are in general arranged opposite the hinge which interconnects the lower part of the closure with the upper part (lid). Alternative solutions are known in the form of tear off bands or breakable bridges which are destroyed during initial opening. Hinge closures in general need to be moulded in open position otherwise it would not be possible to make the interior of the closure. For these closures a considerable amount of tamper evident means are known which are designed to lock when the closure is initially closed and are destroyed when the closure is opened for the first time. The herein discussed invention is directed primarily to the open moulded type of closures.

WO02/060776 (published in August 2002), Benoit-Gonin et al., describes a one piece hinged cap with a lower part and an upper part interconnected by a hinge. The lower part is suitable to be engaged with a neck of a bottle which comprises a dispensing orifice. A tamper-evident band is connected to the lower part by at least two frangible straps having a zone of least resistance for rupture when the closure is opened. The tamper-evident band interlocks with the lid of the closure when the closure is initially closed such that the closure can not be opened without the frangible straps being broken.

FR2802182 (published in June 2001), Benoit-Gonin et al., is directed to a hinged closure having a lower part and a lid which are interconnected by a hinge. The lower part of the closure is suitable to be engaged with a neck of a container and comprises a spout protruding above a top surface. A tamper-band is arranged in the front area of the top surface of the lower part standing perpendicularly above the top surface and following in general along the outer contour of the lower part and designed such that it interlocks with a locking element arranged in a front area of the lid when the closure is initially closed. The tamper-band is interconnected to the lower part via frangible bridges which are intended to break indicating initial opening of the closure.

U.S. Pat. No. 6,347,716 describes a flip top closure with a lower part and a lid which are connected to one another by a single non-snapping hinge connection. A tamper evident flap is extending from the lid of the closure in a closed position downwardly extending across a parting plane where it is connected to the lower part of the closure by ultrasonic spot welding. The flap is severable from either or both sections indicating initial opening of the closure.

U.S. Pat. No. 6,550,626 describes a tamper-evident closure structure with a frangible tamper-evident member extending from the lid to a drop ring. The drop ring is adapted to engage a bottom end of a closure body in the closure system. The lid, the frangible tamper-evident member and the drop ring are provided as a unitary, integrally molded structure. The closure body can also be molded as unitary part of the structure. The lid, the frangible tamper-evident member and the drop ring are assembled on the closure body by first installing the lid in a closed position on the closure body. Then the drop ring is pivoted downward relative to the lid thereby causing the frangible tamper-evidence member to become disposed adjacent to the closure body skirt. The drop ring is located at the bottom of the closure body. By installing the system on a container the drop ring locks under a bead or lip of the container. If the closure body is subsequently removed from the container, a part of the frangible tamper-evident member is severed. If the lid is moved away from its closed position another part of the frangible tamper-evident member is severed because the drop ring, and therefore the frangible tamper-evident member, are prohibited from moving upward. The intention of the described system is that a single tamper-evident feature provides evidence of tampering with the closure body relative to the container and the lid relative to the closure body.

The US-publication US2003/0034323 (published in 2003), Kelly et al., describes a tamper-evident dispensing closure system for containers. The system has a body for extending from the container at the container opening which defines a dispensing orifice, a channel and a retention member projecting over a portion of the channel. The system includes a lid for being moved between a closed position and an open position. An anchor member is provided for being received in the channel and has an engaging portion for engaging the retention member when the anchor member is received in the channel. A frangible web initially connects the anchor member with the lid so that the frangible web breaks when the lid is initially lifted from the closed position.

US2003/0062369 (published in April 2003), Hierzer et al., describes a tamper evident hinge type closure with a body, a lid and a hinge interconnecting the body and the lid. A tamper evident band is provided so as to mechanically secure the lid portion to the body portion at a position that is distal from the hinge. The tamper evident band, which is designed to break upon initial opening of the closure by a consumer, is integral with both the body portion and the lid portion, so as to ensure more reliably than was possible with interlocking mechanical tamper evident structures that the closure may not be opened without defeating the tamper evident band. The tamper evident band is fused to the body of the closure.

US2004/0188374 (published in September 2004), Ochoa, shows a further tamper evident closure having a body and a cover with a hinge. On the body of the closure a tamper band is joined by breakable points wherein in-cuts are established for the retaining of corresponding projections in the cover in its closed position. The tamper-band is provided with end wings that are positioned in depressions of the side surface of the cover without projecting from this. While initial opening the tamper band is removed.

EP0151242 (published in August 1985), Ostrowsky, describes a dispensing closure with a tamper-indicating removable strip which is integrally formed with the lower part of the closure and is secured to one of the closure body end closure cover via frangible bridges. The closure comprises a hinge which interconnects the cover and the body. The strip comprises spaces which mate in the closed position with projections arranged at the cover and avoid unwanted opening. The frangible bridges are severed while initial opening.

EP0515348 (published in November 1992), Sturm et al., describes a tamper proof closure with a retention member in the form of a barbed hook protruding from the lower part of a closure perpendicular to the separation plane. The retention member is engaged in an opening of the lid of the closure while initial closing. The closure can not be opened unless the retention member is destroyed.

WO01/46032 (published on 28 Jun. 2001), Jackel et al., is directed to a hinged-lid closure for containers used to contain a flowable good. The closure comprises a closure body and a lid which is pivotally fastened to the closure body. A tamperproof device is provided with at least one specified point of rupture between the closure cap and the lid in order to optically indicate the actual state. A tamperproof element is held on the closure cap and connected to the lid above the specified point of rupture. The specified point of rupture between the lid and the tamperproof element is at least partially arranged in an interspaced manner underneath the bottom edge of the lid wall. The point of rupture is arranged below the parting plane of the closure.

WO03/026981 (published in April 2003), Jackel et al., describes a dispensing closure for a container which contains a flowable product, especially for a beverage container. The closure comprises a closing body and a lid. A dome-shaped raised section of the body has an outlet opening. The closing body is provided with a covering element that covers at least partially an outer area of the dome-shaped raised section whereby the material of the covering element is softer than the material of the dome-shaped raised section. One aim is to provide a more pleasant feeling when the user comes into direct contact with the dispenser closure.

EP0621199 (published on 26 Oct. 1994), Neveras et al. (Colgate), similar to U.S. Pat. No. 5,386,918, is directed to an assembly of a container having a dispensing nozzle and a hinged closure secured thereto. The closure is having a dispensing channel surrounding the nozzle of the container. The closure lid, cooperatively acting with said closure base so as to seal the said dispensing channel when the closure lid is in a closed position. A tamper evidence structure is attached to the closure base or closure lid and cooperatively acting with the closure base or the closure lid to which it is not attached to lock the closure until removal of the tamper evidence structure. The dispensing channel which surrounds the dispensing nozzle sealingly engages at least the end surface of the said dispensing such that the product to be dispensed, on being dispensed, contacts at most substantially only a limited surface of the dispensing channel of the said closure base.

U.S. Pat. No. 6,405,885 describes a closure for a container with a closure body having a deck and a depending skirt, the skirt being adapted to be mounted on a container neck or formed with the container. A protruding member extends from a surface of the deck, the protruding member including a first locking ledge at an intermediate position along a length of the protruding member. A lid, hinged at one side to the closure body at a position opposite to the protruding member, has a socket on a side of the lid opposite the hinge. The socket has a receiver cavity open in an axial direction of the lid and includes a second locking ledge extending radially within the receiver cavity. The first and second locking ledges are engageable when the protruding member is positioned sufficiently within the receiver cavity at the time the lid is initially closed to the body. The engagement of the first and second locking ledges prevents the lid from being opened from the body, the socket and the protruding member being connected to the lid and the body respectively by frangible elements. The body includes an inset on a surface thereof below the protruding member, and the lid includes an apron extending from the socket. The apron and the inset being shaped and configured such that the apron fits within the inset to be flush with adjoining surfaces of the annular skirt of the body when the lid is engaged to the body.

U.S. Pat. No. 6,296,986 describes a closure with a body and a lid connected by a hinge to the body. A tamper-indicating member includes a press portion connected by a hinge to the lid, and an anchor to the body. The press portion connected at a frangible junction to the anchor portion, whereby the press portion can be moved sufficiently relative to the body to separate the press portion from the anchor portion. The anchor portion is connected to the body by an anchor member extending radially from the body. The anchor portion includes an aperture. The body includes a radially extending head which captures the aperture when the anchor portion is pressed to the body.

WO03/086891 (published in October 2003), Kunz, is directed to a snap action hinge closure with a lower part which is interconnected to a lid via a hinge. The closure is provided with a first tamper-evident band which shall ensure the integrity of the product before the initial opening by means of an appropriately secured joining between the lid and the lower part. A second tamper evident band holds the closure on the neck of a container in a manner that prevents it from being unscrewed.

As it becomes obvious from the list of documents cited above many attempts have been undertaken to improve tamper evidence of closures. However, the known closures in general all have the disadvantages that it is not possible to use them e.g. for gaseous beverages or to re-lock them after initial opening. A further disadvantage is that they are difficult to manufacture because they need relatively complicated moulds or have a design that results in long cycle times which avoid cost efficient production.

It is an object of the present invention to provide an improved tamper evident means for a closure, respectively a tamper evident closure, e.g. suitable for water, carbonated liquids causing internal pressure or other hot or cold liquids which overcomes the disadvantages of the closures known from the prior art.

It is a further object of the present invention to provide an improved tamper evidence solution for closures which is capable in safely indicating initial opening and hinders attempts to defeat the tamper evidence.

It is still a further object of the present invention to provide a tamper evidence solution for closures suitable to re-lock the closure after initial opening.

It is still a further object of the present invention

It is still a further object of the present invention to provide a tamper evidence solution for closures offering a simple mold design.

SUMMARY

A closure according to the present invention in general comprises a lower part (body) with an orifice and an upper part (lid), which interacts with the orifice in the closed position of the closure. The body and the lid are interconnected by a hinge, preferably a snap-hinge. Preferably the hinge is of one of the types as known from EP0746512B1, EP0836576B1, or EP1075432B1. These hinges have no main hinge connection, are very robust and offer furthermore the advantage of symmetric flow paths by filling the mould and a very robust and simple mold design. A further advantage consists in the double hinge mechanism (no main hinge) which offers the opportunity to move the closure parts on non-circular paths around protruding elements, which is often not possible with conventional hinges.

The body of the closures in general comprises a disc like top portion and an outer skirt with interconnecting means such as e.g. an internal thread suitable to be engaged with an external thread of a standardized neck of a container. Normally an orifice with a pouring opening is incorporated in the disc like top portion which may be tightly closed by sealing means incorporated in the lid of the closure.

The closures according to the present invention further comprises integrated tamper-locking means providing improved tamper evidence and allowing to securely re-lock the closure after initial opening. The tamper evidence and the tamper-locking means are preferably integrated to each other such that they are complementing each other especially regarding their tamper evidence functionality. The design of the tamper-locking means is such that the locking-means are supporting the functionality of the tamper-evidence means when the closure is closed resulting in an increased tamper-security.

In a preferred embodiment the lower part of a hinged closure comprises, essentially opposite to the hinge arrangement, a locking element rigidly connected to the body of the closure. This first locking element is either arranged within the outer contour of the closure and/or protruding over the contour of the closure and has a first and a second locking rim arranged in general perpendicular to a general plane of symmetry of the closure. The first and the second locking rim which protrude from the locking element are forming a first and a second undercut. Vertically above the inner and the outer undercut the locking element preferably has the shape of a wedge to allow better application. Depending on the design of the closure the first and the second undercut may be arranged at the same or at a different level. In a preferred embodiment the locking element has a bridge like shape with a passage underneath whereby the ceiling of the passage forms part of the first locking rim.

In a preferred embodiment the lid of the closure comprises in a front area, in general opposite to a hinge a socket suitable to engage with the locking element arranged at the body. The socket is formed by an inner first and an outer second wall area which are arranged at a distance to each other forming a gap suitable to receive and securely hold the locking element of the body. At least one side of the socket is delimited by a frangible element which interconnects the inner and the outer wall area directly or indirectly until initial opening. At the inner and the outer wall areas a first tie rod/counter locking means and a second tie rod/counter locking means are arranged whereby at least one is protruding inside the gap between the inner and the outer wall area. The inner and the outer wall areas and the inner and the outer tie rod are preferably designed such that they are demouldable parallel to the main opening direction of the mould. In the region where the inner and the outer tie rod are arranged the inner and the outer wall areas are deformable in radial direction to allow a limited deformation such that at least one counter locking means may engage with the locking element. The inner and the outer wall areas are preferably designed such that they cover the locking element such that an attempt to defeat the tamper evidence of the locking device is successfully prohibited. The inner and the outer wall area at least partly surround the locking element tightly, such that it is not possible to successfully insert any object between a wall area and the locking element.

The inner and the outer tie rod are designed and arranged such that they are suitable to interlock with the inner and the outer locking rim of the locking element of the body when the closure is initially closed. The locking element of the body and the socket of the closure are designed and arranged such that they form an initial zone of contact between the body and the lid when the closure is closed for the first time after moulding. Thereby the locking element mates with the gap between the inner and the outer wall area. Before the inner and the outer tie rod of the lid interlock with the inner and the outer locking rim of the body the inner and the outer tie rod are pressed apart in that the inner and the outer wall area are elastically deformed. In the final end closing position of the lid the inner and the outer tie rod are snapped into under the inner and the outer locking rim holding the lid firmly closed.

The outer wall area of the socket of the lid is interconnected to the lid by at least one frangible element such as a thin web of material or bridges. The frangible elements are thereby designed such that they are not destroyed due to initial closing of the lid when the gap is widened due to mating of the locking element with the socket.

To open the lid of the closure the outer wall area has to be removed by breaking the at least one frangible element. Due to the reason that the inner tie rod is still engaged with the inner locking rim of the locking element the closure can then only be opened by pressing the inner wall area of the lid radially inwardly such that the inner tie rod disengages. One advantage of the herein described double acting locking mechanism is that it is possible to hold pressure above atmospheric level within a container.

A preferred embodiment of a tamper evidence means for a closure comprises a locking element having a first and second locking rim interconnected to a first part of the closure. The locking element is suitable to be engaged from two opposite sides with a first and a second counter locking means arranged inside at least one socket interconnected to a second part of the closure. To disengage the locking element, at least one counter locking means is arranged removable and the other is arranged displaceable. The tamper evidence means may be interconnected by at least one frangible element to the second closure part. The at least one frangible element may comprise a thin web of material or a bridge. Depending of the field of application the at least one frangible element is arranged horizontally (x, y) and/or vertically (z).

In a preferred embodiment the locking element has an in general bridge-like or an in general T-like shape. To allow simplified closing of the closure the locking element has the shape of a wedge in the area forming the first contact zone with the socket while initial closing. To open the closure the counter locking means is arranged displaceable preferably in a direction arranged in general perpendicular to the locking direction. In a preferred embodiment the locking rims are arranged in general at the same or at a different level with respect to each other. In a closure the tamper evidence means is integrated in the outer contour of the closure or protruding above the outer contour, especially of a closed closure.

Closures according to the present invention are preferably designed to be engaged with containers comprising a standardized neck e.g. containers made out of polyethylene comprising a cylindrical neck portion with an external thread on an outer peripheral surface whereby an upper end part of the neck portion, positioned above the external thread, has an annular top surface extending substantially horizontally when the container is standing upright. Furthermore the neck of the container comprises a cylindrical, inner peripheral surface adjacent to the annular top surface. Between the annular top surface and the thread a free vertical surface extends over a length of approximately 1 mm to 3 mm of the neck which is not covered by the thread.

Preferably the plastics material of the closure is high density polyethylene, low density polyethylene, polypropylene or a combination thereof. Where the container is to be used for gaseous liquids, the plastics material preferably has a very low porosity to the gas. If appropriate the closures are made in a multi component injection molding process comprising a liner and/or a barrier made out of different materials or a lid which is made out of a different color or material then the body. Depending on the field of application the closure may consist out of several material components injected similarly or sequentially into a mould.

Closure according to the present invention may be interconnected to a neck of a container in a different way then by threaded engagement. Suitable interconnections may be achieved e.g. by snap connections or welded connections.

DESCRIPTION OF THE DRAWINGS

Embodiments of the invention are explained according to the following drawings in more detail.

DESCRIPTION OF THE EMBODIMENTS

Corresponding features of the several shown embodiments do in general and if not indicated otherwise have corresponding reference numbers.

Figure 19:
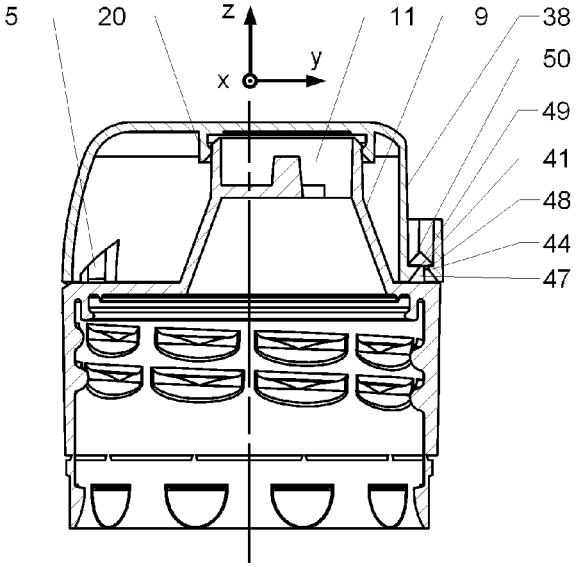
FIG. 19 shows a cross cut through a the front section of the closure of FIG. 18 along line HH.
Figure 20:
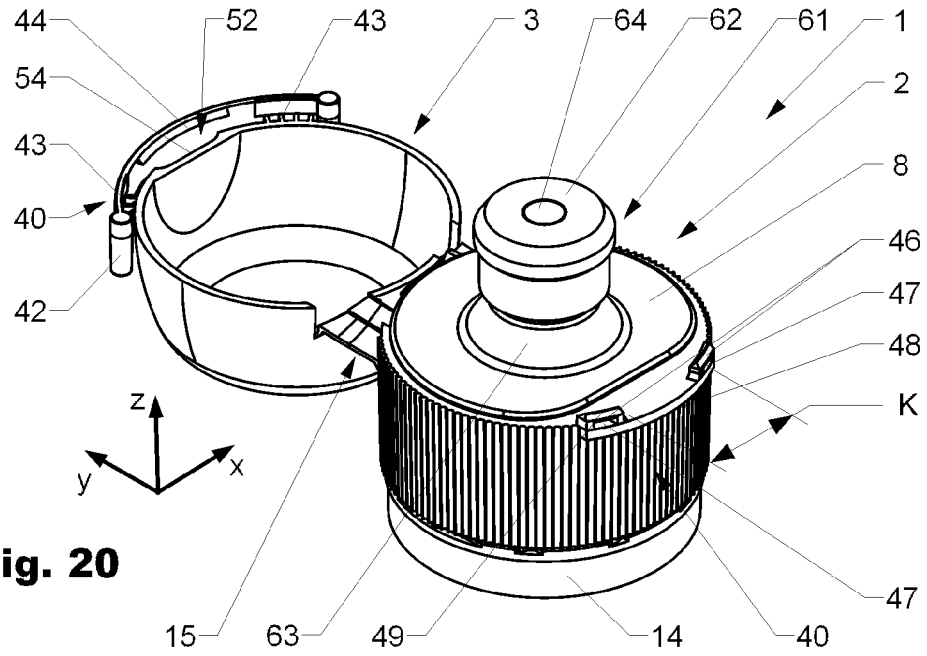
FIG. 20 shows a third embodiment of a closure in a perspective view.
Figure 21:
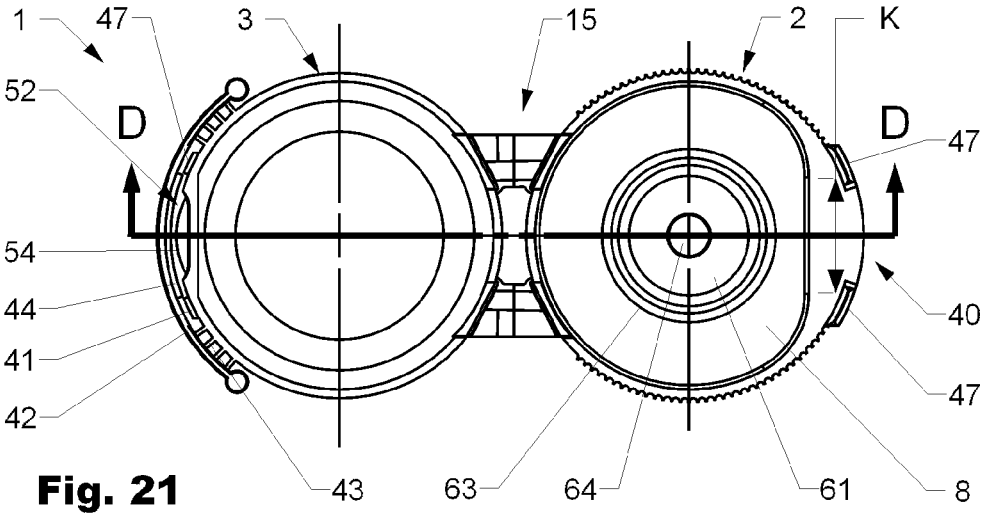
FIG. 21 shows the closure according to FIG. 20 in a top-view.
Figure 22:
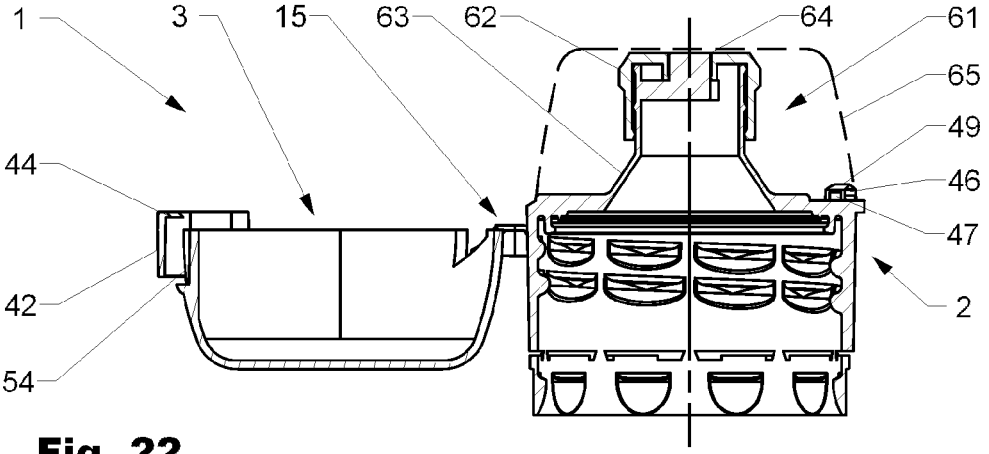
FIG. 22 shows a section view of the closure according to FIG. 21 along line DD.
Figure 23:
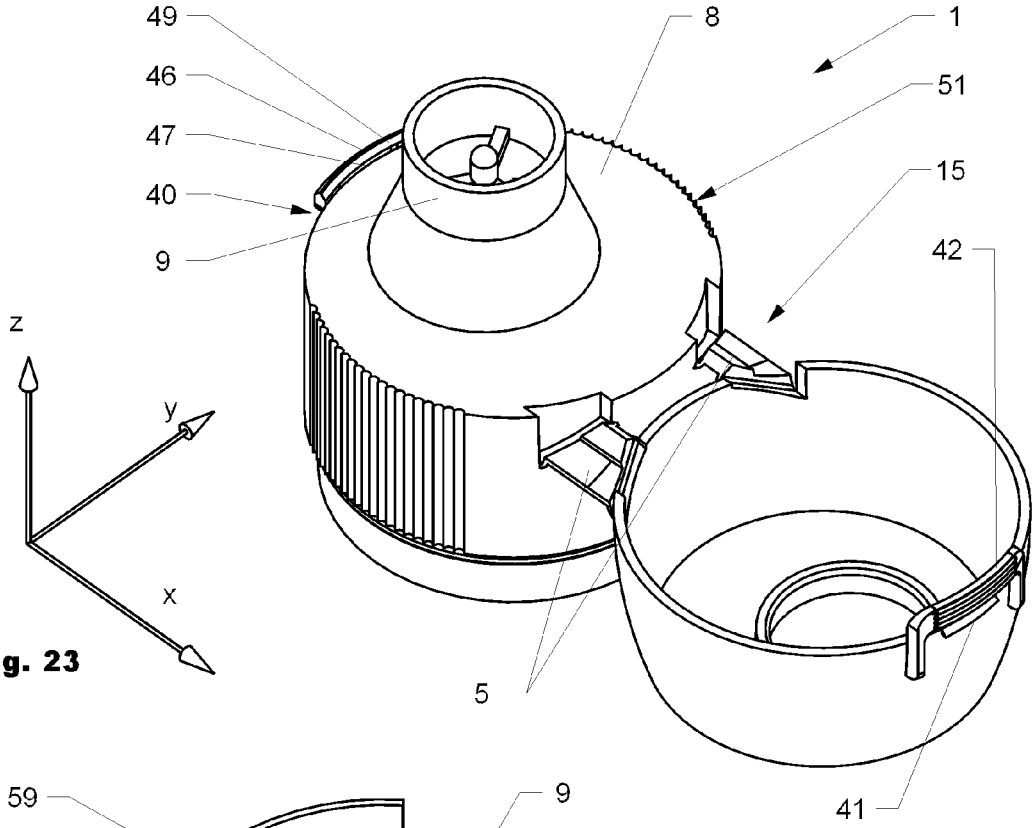
FIG. 23 shows a fourth embodiment of a closure in a perspective view.
Figure 24:
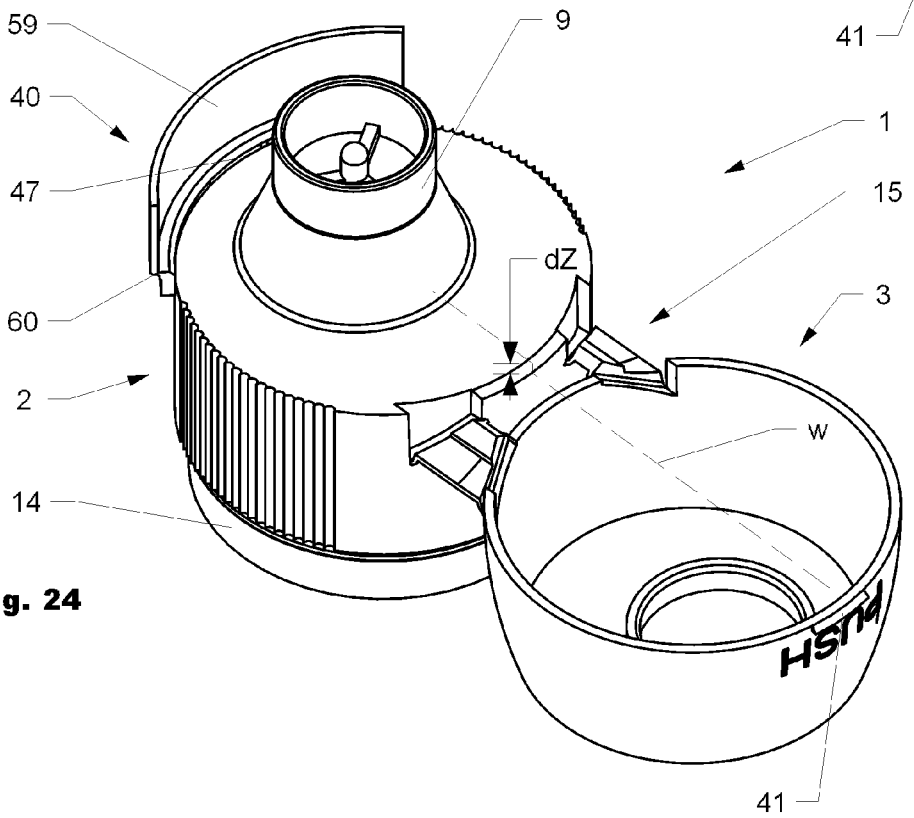
FIG. 24 shows a fifth embodiment of a closure in perspective view.

FIG. 1 through FIG. 14 are showing a first, FIG. 15 through FIG. 20 a second, FIG. 21 through FIG. 23 a third, FIG. 24 a fourth and FIG. 25 a fifth embodiment of a closure 1 according to the present invention in different views and details. The embodiments mainly differ with respect to their tamper-lock features.

Figure 1:
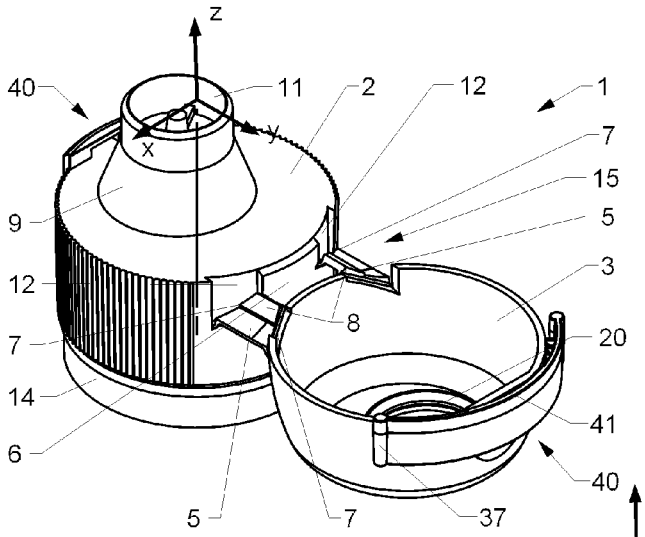
FIG. 1 shows a first embodiment tamper evidence means in connection with a hinged closure in an open position in a first perspective view.
Figure 2:
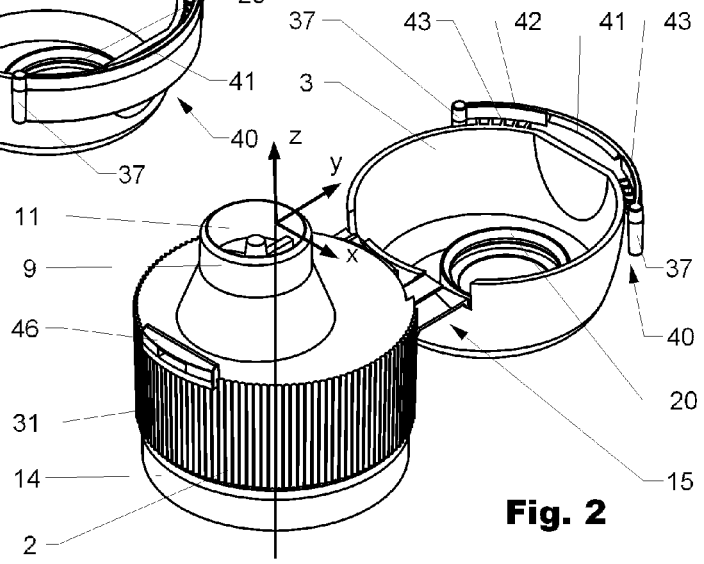
FIG. 2 shows the closure of FIG. 1 in a second perspective view.
Figure 3:
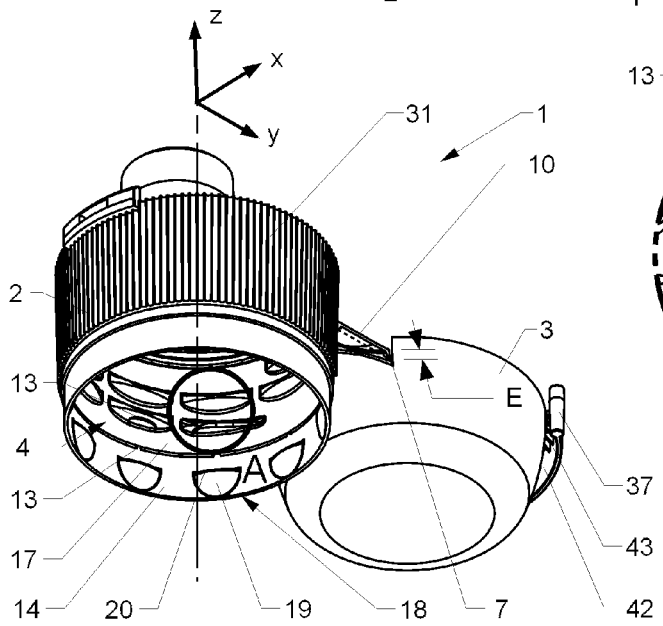
FIG. 3 shows the closure of FIG. 1 in a third perspective view.
Figure 4:
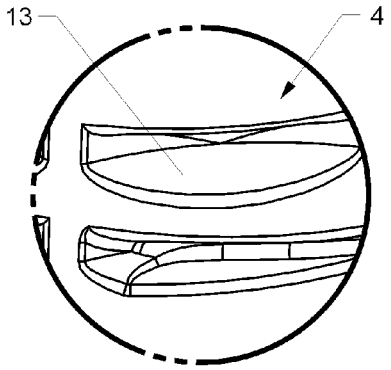
FIG. 4 shows detail A of FIG. 3.
Figure 5:
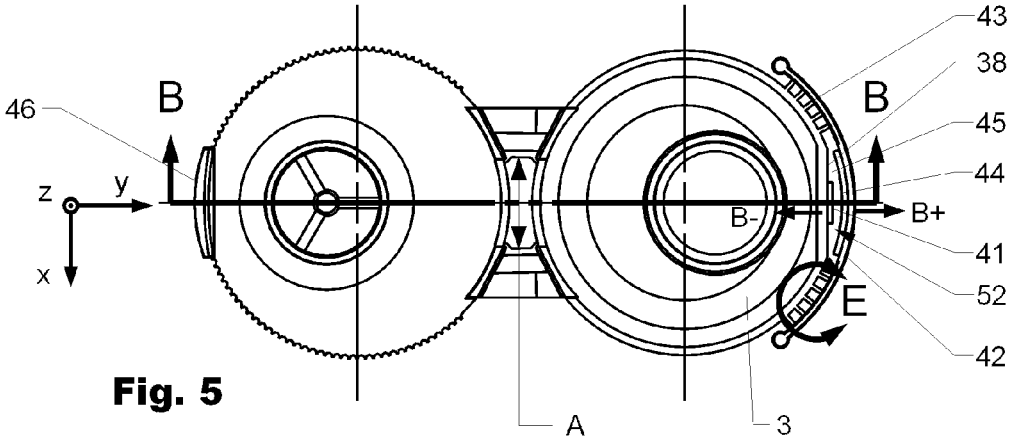
FIG. 5 shows the closure according to FIG. 1 in a top view.
Figure 6:
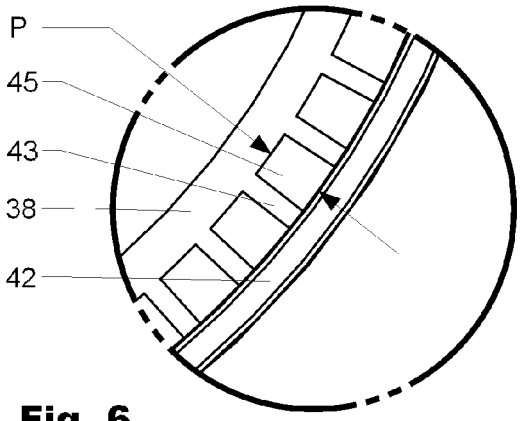
FIG. 6 shows detail E of FIG. 5.

When FIG. 1 and FIG. 2 are showing the first embodiment of closure 1 from above in a perspective back (FIG. 1) and a perspective front view (FIG. 2), FIG. 3 is showing the closure 1 in a perspective front view from below. FIG. 4 is showing detail A of FIG. 3 in a magnified manner. FIG. 5 is showing the same closure in a top view (z-direction) and FIG. 7 is showing the closure of FIG. 5 in a cross cut side view along line BB.

With respect to FIG. 1 the shown embodiments of closure 1 comprise a body 2 which is interconnected to a lid 3 by a snap hinge assembly 15. The shown snap hinge assembly 15 is very robust and has a large opening angle compared to other known hinges. In general it consists out of a pair of trapezoid elements 5 spaced a distance A (see FIG. 5) apart from each other having a gap 6 in between. Each of the trapezoid elements 5 is rotatable connected to the lid 3 and the body 2 by hinges 7, preferably film hinges (thin web of material) having a rotating axis. The hinges 7 of each trapezoid element 5 are preferably arranged in a plane (not shown in detail). To provide a coordinated behavior of the snap hinge assembly 4 the trapezoid elements 5 are preferably made such that they are torsionally stiff with respect to the forces occurring when opening and closing the lid 3 of the closure 1. In the shown embodiment of the snap hinge assembly 4 the inner edges 8 of the trapezoid elements 5 are thickened to increase torsional stiffness to avoid unwanted buckling when the closure 1 is opened and closed. As it can be seen in FIG. 3, outer edge 10 of each trapezoid element 5 is set back by a distance E with respect to film hinge 7. Thereby it is achieved that the snap effect of the snap hinge assembly 4 is improved. A further advantage is that the trapezoid elements 5 are, when the lid 3 is in closed position above the body 2, fully arranged inside pockets 12 of the body 2 such that their outer contour is integrated into the outer contour of the closure 1. The shown hinge assembly 15 is working as a double hinge mechanism with two lower hinges 7, interconnecting the body 2 and the two trapezoid elements 5, and two upper hinges 7, interconnecting the lid 3 and the two trapezoid elements 5. It has been proved that especially this double hinge mechanism is very helpful when a lid 3 has to move around a spout 9 which is significantly protruding above a main deck 8 of closure body 2, as e.g. preferred with closures for soft drinks. However, depending on the field of application, other snap hinges may be applicable. As it can be seen in FIG. 7 (cut side view) the snap hinge assembly 4 is arranged at a distance A below the main deck 8 of the closure 1. This is advantageous in so far that it offers maximum clearance of the spout 9 when the lid 3 is open. By that it is possible to easily drink from the opening 11 of spout 9. On the inside of the lid 3 a sealing means/plug 20 is visible which serves to tightly seal the opening 11 of the spout 9 in the closed position of the closure 1.

The body 2 and the lid 3 of the shown embodiments of closure 1 and their inside are in general similar to each other and are therefore explained in more detail with reference to FIGS. 3 and 7.

Figure 7:
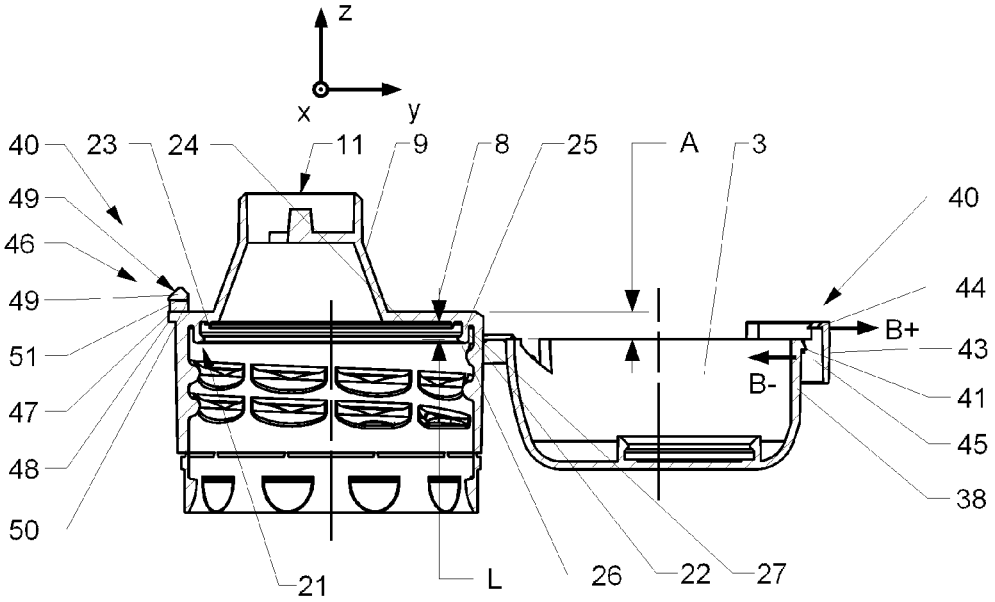
FIG. 7 shows a cross cut through the closure of FIG. 5 along line BB.

As it can be seen best in FIGS. 3 and 7 body 2 of the exemplary embodiments of closure 1 comprises an internal thread 4 which consists out of essentially similar thread segments 13 suitable to be applied onto a neck of a container having an appropriate external thread (not shown in detail). As it can be seen from FIG. 3 the closure 1 comprises at its lower end a tamper evidence band 14 which is interconnected to the upper part of body 2 via frangible first bridges 16. The first bridges 16 are designed such that they withstand stress occurring while ejection of the closure out of a cavity of an injection mould and pop-on onto the neck of a container but break due to tension forces when initially opening of the closure by unscrewing, preferably before gas escapes due to internal pressure. The bridges of the shown embodiment have essentially the shape of a frustum whereby the inner surface of the frustum arranged at the inside of the closure is aligned with inner side surface 17 of the body 2 such that no hindering undercut results. The tamper evidence band 14 comprises along its inside barbes 18 with an in general spherical or ellipsoidal lower part 19 and with respect to the center axis z of the closure 1 an in general conical upper part 20. The barbs 18 are formed such that they are suitable to be engaged with a protruding rim of a neck of a container (not shown). The shape of the lower part 19 is relevant during pop on of the closure onto a neck of a container to avoid mismatch and/or tilting. Due to the shape of the lower part 19 it is achieved that the barbs 18 are contacting the neck of the container only point by point which results in less no-go. The barbs 18 and the bridges 16 are herein aligned to each other such the bridges 9 are directly ruptured when unscrewing the closure 1 from the neck of a bottle. However, depending on the field of application another thread or tamper band may be appropriate.

As it can be best seen in FIG. 7 closure body 2 of the shown embodiments comprises a sealing means 21 with an in general P-shaped side seal 22 and a top seal 23 protruding from the inner top surface 24 in a generally perpendicular way. The side seal 22 has an in general P-shaped cross-section with a base 25 and an annular sealing ring 26 protruding radially inwardly suitable to seal on an outer peripheral surface of a neck of a container (not shown in detail). The side seal 22 is arranged radially distanced to the outer skirt of the body by an annular gap 27. The thickness of the annular gap 27 is chosen such that the annular sealing ring 26 and the base 25 may extend at least initially freely in radial direction while the closure is popped onto a neck of a bottle. If appropriate the sealing means may controllably contact the outer skirt 15 in a later stage. The vertical length L of the base 25 of the side seal 22 is chosen such that the annular sealing ring 26 is preferably arranged as far as possible down along the free length of the outer vertical surface of the neck of a container in the shown embodiment just above the thread start of the container. The herein shown laterally flexibly adjustable and vertically stiff base 25 of the side seal 22 guarantees that the annular sealing ring 26 may sideways adjust even while pop-on of the side seal 22 onto a neck of a container which is eccentric, especially in radial direction. The lateral bending stiffness of the base 25 is mainly a function of the diameter, the thickness and the vertical length of the base 25. By these parameters the lateral flexibility may be adjusted to needs given. To obtain a radial sealing force the inner diameter of the annular sealing ring 26 is smaller than the outer diameter of a neck of a container (not displayed in detail).

Top seal 23 of the shown exemplary embodiment has, with respect to the centre axis z of the closure 1 an essential conical outer surface and an in general cylindrical inner surface interconnected by a toroidal surface. The top seal of the shown embodiment is made such that it preferably folds in a defined radially due to the conical and the cylindrical surface, when engaged with the annular end section of a neck of a bottle. However, other suitable sealing means, e.g. symmetric, may be applicable depending on the field of application.

As best visible in FIGS. 1 through 3 the shown embodiment of closure 1 comprises along the outer surface knurls 31 improving traction while applying and unscrewing of the closure 1. In a preferred embodiment the shown knurls 31 have a circular cross-section helping to improve the stability of the closure while reducing the overall weight. However another shaped outside may be appropriate.

According to FIGS. 1 through 14 and as best visible in FIGS. 5, 7 and in FIGS. 8 through 13, the shown embodiments of the closure 1 according to the present invention comprise an improved double action tamper evidence means/locking mechanism 40 which indicates initial opening of the lid 3 and also offers the opportunity to close and securely re-lock the lid 3 of the closure 1 after initial opening. Therefore lid 3 of the shown embodiment comprises on its front end a flat wall area 38, which is radially inwardly deformable in the direction of arrow B− (see FIG. 7), with a protruding straight locking tooth (first counter locking means) 41 arranged behind a curved and in a defined manner radially outwardly (arrow B+, see FIG. 7) deformable tear of element 42. The tear of element 42 has a curved shape following the outer contour of the lid 3 at a certain distance. At each end the tear off element comprises handles 37 (see FIG. 2) to allow easy holding of the tear off element 42. The tear of band 42 is arranged at a distance P (see FIG. 6) from the outer contour of the lid 3 interconnected with the lid 3 via frangible elements 43 which are in the shown embodiment arranged next to each other. The tear off band 42 comprises a curved protruding skirt (second counter locking means) 44 arranged in a gap 45 between the tear off band 42 and the lid 3 in the shown embodiment approximately opposite the locking tooth 41. The tear off element 42 and the locking tooth 41 are designed such that they are accessible from above and from below (z-direction) and therefore mouldable without shifting elements. The locking tooth 41 and the protruding skirt 44 are part of a socket 52 suitable to be engaged with a locking element 46 arranged at the body 2 of the closure 1. As it can be seen the lateral extension of socket 52 is delimited by frangible bridges 43. The locking element 46 is arranged in the front area of the body 2 and comprises an opening 47, extending here in radial direction through the locking element 46, and a lower rim 48. Alternatively or in addition the locking element may have an in general T-shaped design. The locking element 46 is on it's upper end 48 wedge-like chamfered such that it can be easily inserted between the outer wall area 38 of the lid and the tear off element 42 to engage with the locking tooth 41 and the protruding skirt 44 during initial closing the closure 1.

The integrated locking means 41, 44 do not only provide tamper evidence but also allow to securely re-locking the closure 1 after initial opening. The tamper evidence 42 and the counter locking means 41 are integrated such that they are complementing each other to improve their overall functionality. The design of the tamper-locking means 41, 42 is such that the locking-means 41 are supporting the functionality of the tamper-evidence means when the closure 1 is closed resulting in a increased tamper-security.

Figure 8:
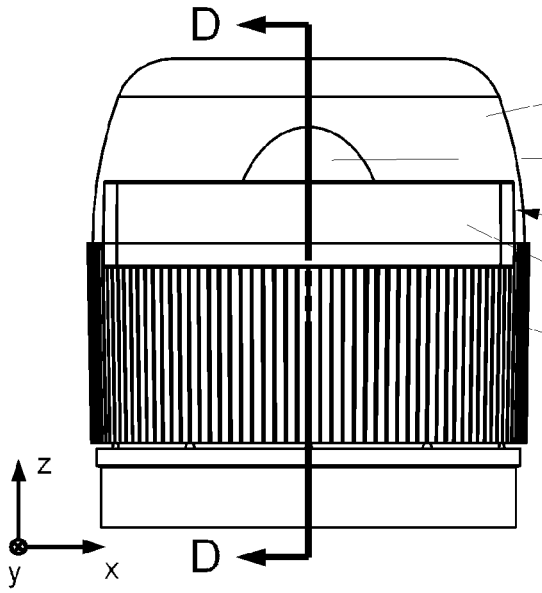
FIG. 8 shows the closure according to FIG. 1 in a closed position in a front view.
Figure 9:
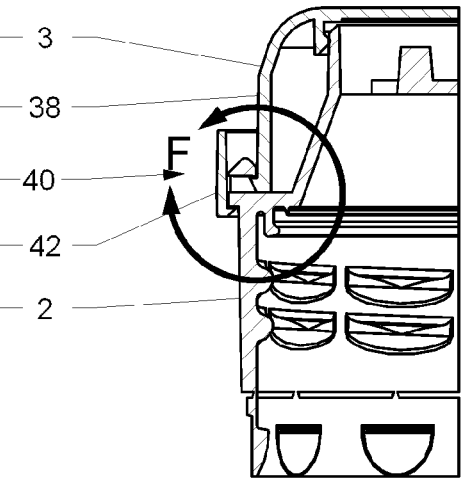
FIG. 9 shows a cross cut through the front section of the closure according to FIG. 8 along line DD.
Figure 10:
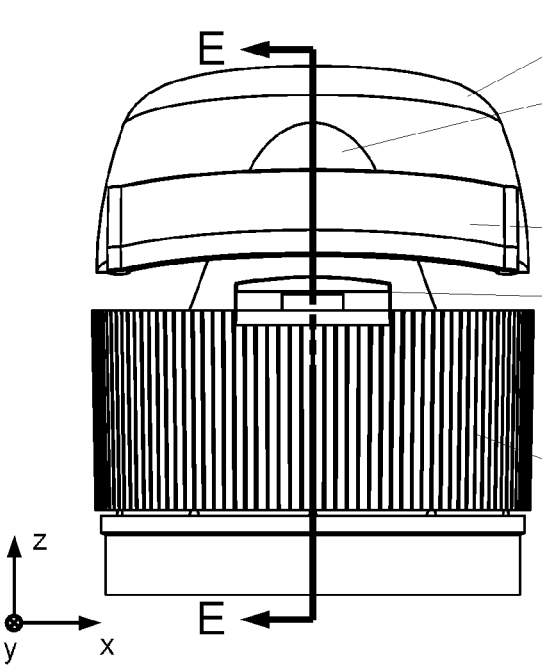
FIG. 10 shows the closure according to FIG. 1 in an slightly open position in a front view.
Figure 11:
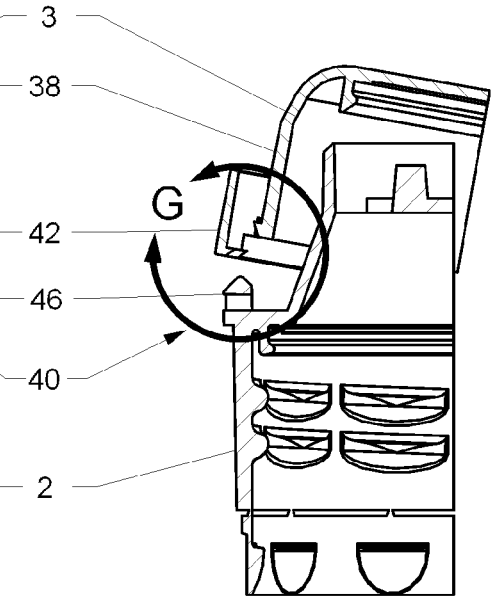
FIG. 11 shows a cross cut through a the front section of the closure of FIG. 10 along line EE.

With reference to FIGS. 8 through 13 the locking mechanism 40 is explained in more detail. FIG. 8 is showing the front area of the closure 1 according to FIGS. 1 to 7 in a front view in closed position and FIG. 9 in a slightly open position. The FIGS. 9 and 11 are showing cross cuts along the line DD (FIG. 9) and EE (FIG. 11). When FIGS. 8 and 9 are showing the tamper-locking means 41, 42 interlocked with the locking element 46 in a closed position of the lid 3 above the body 2 closing the orifice 11 of the spout 9, FIGS. 10 and 11 are showing the same closure shortly before the lid 3 is closed the first time. Details F and G of FIGS. 9 and 11 are subject of FIGS. 12 and 13.

The locking element 46 is rigidly connected to the body of the closure. This locking element 46 is either arranged completely within the outer contour of the closure, as it can be seen in the embodiment according to FIGS. 15 to 20, and/or protruding over outer contour of the closure 1, as it can be seen in the embodiment according to FIGS. 1 to 14, and has a first inner 50 and a second outer locking rim 48 arranged in general perpendicular to a general plane of symmetry (herein defined by YZ-axis of the closure coordinate system) of the closure 1. The inner and the outer locking rim 48, 50 are forming an inner and an outer undercut 48, 50. Vertically above the inner and the outer undercut the locking element preferably has the shape of a wedge 49. Depending on the design of the closure the inner and the outer undercut may be arranged at the same or at a different level. As it can be seen in the shown embodiment the locking element 46 has a bridge like shape with a passage 47 underneath whereby the ceiling 51 of the passage 47 forms inside part of the first inner locking rim 50.

An advantage of the bridge like shape of the locking element 46 is in that it is possible to make the undercut of the inner locking rim 50 relatively simple by a shifting element (slider) arranged in the cavity of the mould.

The locking element 46 is preferably arranged at a rigid part of the closure, here the front area of the body 2, such that it does not displace under the forces applied to it. In difference to the locking element 46 the flat wall area 38 and the tamper element 42, which carry the inner and the outer tie rod 41, 44, must be deformable such that the tie rods 41, 44 can be disengaged from the locking element 46. As it becomes obvious from the functionality the position of the locking element 46 and the tie rods 41, 44 are relevant for the function of the locking mechanism.

Figure 12:
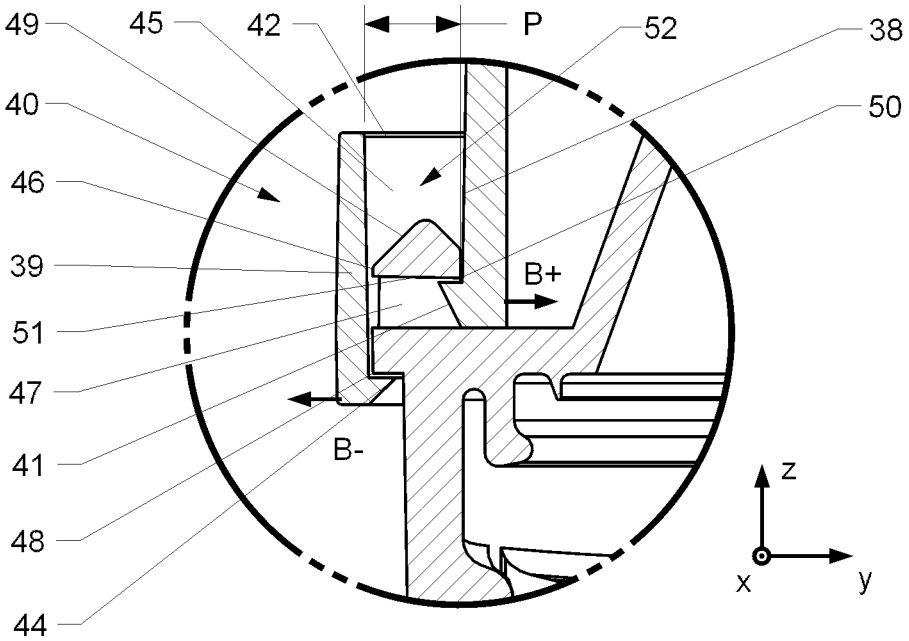
FIG. 12 shows detail F of FIG. 9.
Figure 13:
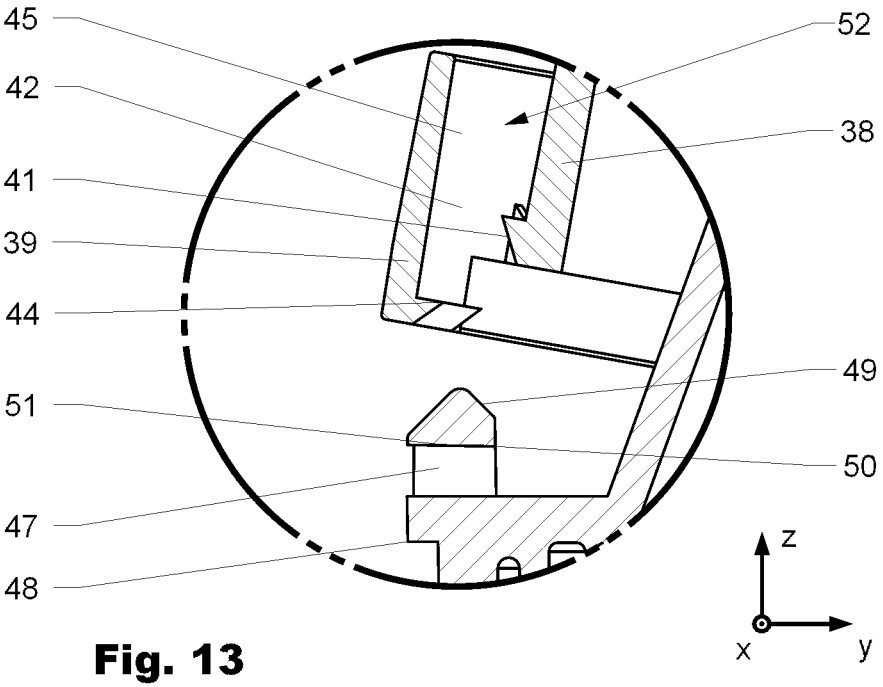
FIG. 13 shows detail G of FIG. 11.

While in FIG. 12 the lid 3 is displayed in the closed position with the locking mechanism 40 locked, FIG. 13 is showing the closure 1 immediately before the lid 3 is fully closed. The tamper-locking mechanism 40 is thus not yet engaged. As it can be seen in FIGS. 12 and 13 the straight wall area 38 and the tear-off element 42 are forming a socket 52 suitable to engage with the locking element 46 of body 2 by temporary lateral elastic deformation. The socket 52 is formed by the inner first wall area 38 of lid 3 and a second wall area 39 of the tear-off element 42 which are at distance P to each other forming the gap 45 suitable to receive the locking element 46. As it can be seen the tear-off element 42 fully covers the locking element 46 such that it is not possible to defeat the tamper evidence. In the present embodiment the tear-off elements extends across the main separation plane of the closure 1 and interlocks with the outer locking rim 48. Thereby an attempt to defeat the tamper evidence, e.g. by inserting an object, is not possible. The locking tooth 41 and the skirt 44, which are arranged protruding inside the gap 45 between the inner and the outer wall area 38, 39, are serving as an inner and an outer tie rod. The lower end of the locking tooth 41 and the protruding skirt 44 are chamfered such that they may easily engage with the locking element 46 during initial closing of the lid 3. The inner and the outer wall areas and the inner and the outer tie rod are preferably designed such that they are demouldable parallel to the main opening direction (z-direction) of the mould. In the region where the inner and the outer tie rod are arranged the inner and the outer wall areas are preferably deformable in radial direction to allow a limited deformation.

The inner and the counter locking means 41, 44 are designed and arranged such that they are suitable to interlock with the inner and the outer locking rim 48, 51 of the locking element 46 of the body 2 when the lid 3 is initially closed. The locking element 46 of the body 2 and the socket 52 of the lid 3 are designed and arranged such that they form an initial zone of contact between the body 2 and the lid 3 when the lid 3 is closed for the first time after moulding. Thereby the locking element 46 mates with the gap 45 between the inner and the outer wall area 38, 39. Before the inner and the outer counter locking means 41, 44 of the lid 3 interlock with the inner and the outer locking rim 48, 52 of the body 2 the inner and the outer tie rod are pressed apart in that the inner and the outer wall area are elastically deformed in direction of arrows B+ and B−. In the final closing position, as displayed FIG. 12, of the lid 3 the inner and the outer counter locking means 41, 44 are engaged behind the inner and the outer locking rim 48, 51 of the locking element 46 holding the lid 3 firmly closed.

As it can be seen in FIG. 12 the inner and the counter locking means (tie rod) 41, 44 are having an effect on the locking element 46 from the inside and from the outside supporting each others functionality before the closure is opened for the first time. E.g. if somebody makes an attempt to open the closure without removing the tear-off element he would pull the outer tie rod radially outwardly in the direction of B−. Even though it would be possible to pull the lower end of the tear-off element as far out that the outer tie rod 44 would disengage from the outer locking rim 48 without breaking the frangible bridges 43, the locking mechanism would still not disengage, because of the inner tie rod 41 still being engaged with the inner locking rim 52. In fact pulling the tear-off element in the direction B− results in that the inner tie rod is engaging more firmly with the inner locking rim 52. This interaction of the inner and the outer locking elements is one reason that the herein disclosed locking-mechanism is save.

To open the lid 3 of the closure 1 the tear-off element 42 has to be completely removed by breaking the frangible elements 43. Due to the reason that the inner tie rod 41 is still engaged with the inner locking rim 52 of the locking element 46 the closure 1 can only be opened by pressing the wall area 38 of the lid radially inwards in the direction B+ such that the inner tie rod 41 disengages from the inner locking rim 52.

A further advantage of the herein disclosed double acting tamper-locking mechanism is that it is possible to hold pressure with in the container.

Figure 14:
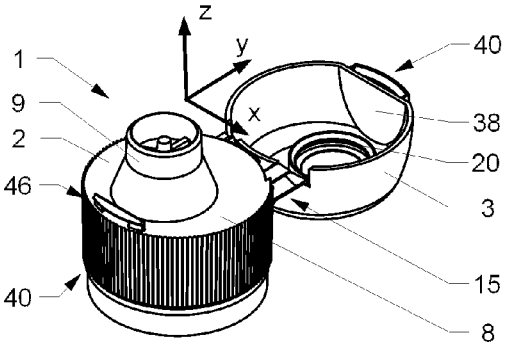
FIG. 14 shows a second embodiment of a closure in an open position in a perspective view from above and front.
Figure 15:
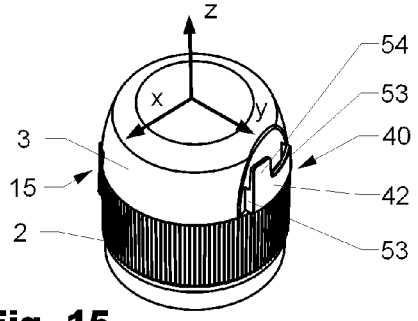
FIG. 15 shows the closure according to FIG. 14 in a closed position in a perspective view from above and front.
Figure 16:
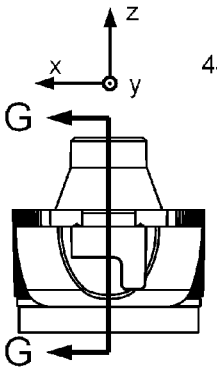
FIG. 16 shows the closure according to FIG. 14 in a front view.
Figure 17:
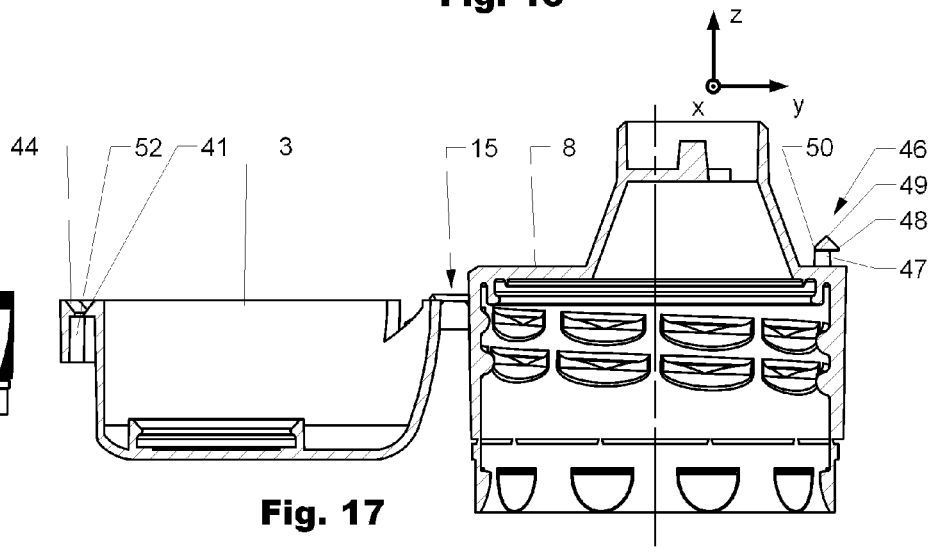
FIG. 17 shows a cross cut through a the closure of FIG. 16 along line GG.
Figure 18:
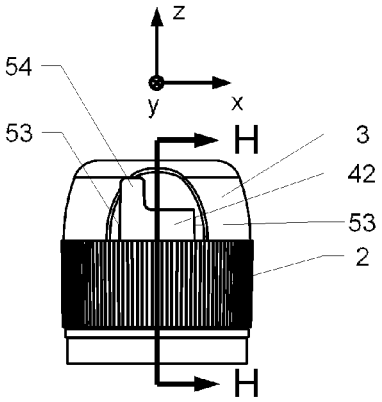
FIG. 18 shows the closure according to FIG. 15 in a front view.

FIGS. 14 through 15 are showing a second embodiment of a closure 1 with a locking mechanism 40 according to the present invention. FIG. 14 is showing the closure 1 in an open position and FIG. 15 is showing the same closure in a closed position. FIG. 16 is showing the closure 1 according to FIGS. 14 and 15 in an open position in a back view and FIG. 18 the same closure in a closed position in a front view. FIG. 17 (open position) and FIG. 19 (closed position) are showing the cross-cuts through the closures according to FIGS. 16 and 18 along cutting-lines GG and HH.

In difference to the closure according to FIGS. 1 to 13 the locking element 46 is arranged in closed position in general above the main deck 8 of the body 2 and with respect to the hinge assembly 15 on the opposite side of the orifice 9. An advantage of this arrangement is that the tamper evident means/locking mechanism 40 is, as it can be seen in FIGS. 15 and 19, fully integratable in the outer contour of the closure 1.

FIG. 19 is showing the lid 3 and the tamper-locking mechanism 40 in a closed and interlocked position where the inner and the outer counter locking means 41, 44 are locked behind the inner and the outer locking rim 48, 50. The trapezoid elements 5 are arranged inside the pockets of the body 2 and the opening 11 of the orifice 9 is tightly closed by the seal 20 arranged inside lid 3. The inner and the outer locking rim 48, 50 are arranged at an in general the same level with respect to z-direction which results in a direct and very efficient interaction and therefore in an improved tamper evidence.

As it can be best seen in FIG. 15 the tear-off element 42 is on each side interconnected to the lid 3 by a frangible thin web 53 of material which is arranged in closed position at an in general vertical direction. The frangible elements 53 are thereby designed such that they are not destroyed due to closing of the lid when the gap 45 of the socket 52 is widened due to mating of the locking element with the socket. Instead of a single web of material a series of bridges may foreseen (not shown in detail). The bridges are in a preferred embodiment aligned stair-like with respect to each other such that they can be demoulded. They are aligned vertically (z-direction) with a small offset in horizontal direction with respect to the each neighbor such that they are accessible in the mold in vertical direction.

The tear-off element 42 comprises a handle 54 for holding and removing the tear-off element 42.

FIG. 20 is showing a further embodiment of closure 1 in an open position in a perspective and FIG. 21 in a top view. FIG. 22 is showing the closure 1 according to FIG. 21 in a sectional view along line DD (see FIG. 21).

The principle of the tamper evidence means/locking mechanism 40 is in general the same as of the other embodiments. However, instead of a single central, the shown tamper evidence means 40 comprises two locking elements 46 arranged laterally spaced apart to each other by a distance K. Each of the locking elements 46 has a wedge like top end 49 and an opening 47 suitable to interlock with two locking teeth (counter locking means) 41 projecting above the outer surface of the lid 3 of the closure 1. Similar to the other closures a tear off element 42 is interconnected via frangible elements 43 to the lid 3. Between the outer surface of the lid 3 and the tear-off element 42 a socket 52 is formed suitable to receive the locking elements 46. At the inside of the tear-off element 42 a protruding skirt (second locking element) 44 is arranged protruding radially inwardly and which interlocks in closed position of the closure 1 with an outer lower edge 48 of the body 2. Between the two laterally spaced apart locking teeth 41 the lid 3 comprises on it's outside a finger recess 54 allowing central gripping of the lid, which is initially covered by the tear-off element 42. Only by removing the tear-off element 42 access to the finger recess 54 may be obtained. By pressing the finger recess 54 radially inwardly the flexible lid 3 deforms such that the locking teeth 41 are disengaged and the lid 3 may be opened.

The shown closure 1 has push-pull spout 61 which comprises a vertical displaceable cap 62 to open and to close the spout 61. The cap 62 is made in the herein shown embodiment as a separate part which is assembled with the lower part 63 of the push-pull spout 61 when the closure 1 is still in open position. In a lower position of cap 62 an opening 64 is sealingly locked. In the shown embodiment the internal height of the lid 3 corresponds to the height of the push-pull spout 61 including the cap 62 in closed position such that lid 3 secures in closed position, when the lid 3 is positioned above body 3 (schematically indicated by line 65) and the tamper evidence means 40 is engaged and locked, the cap 62 in closed position such that no unwanted opening may occur.

FIG. 23 and FIG. 24 are showing two hinged closures 1, e.g. suitable for sealing of water bottles, in an open position (as moulded) such that the base 2 and lid 3 are visible. The closures 1 are, with the exception of the tamper evidence means 40, in general similar to each other. The base 2 and the lid 3 are interconnected by a hinge 15, preferably a hinge without a main hinge connection such as e.g. known from U.S. Pat. No. 6,634,060 (from now on U.S.'060) consisting of two torsionally rigid trapezoid elements 5 which provide a coordinated behavior of the closure parts 2, 3 with respect to each other while opening and closing. A hinge according to U.S.'060 further offers the flexibility to overcome an orifice (spout) 9 which significantly protrudes over the top deck 8 of the base 2 of the closure 1. To guarantee that the lid 3 is as far away from the orifice 9 as possible the hinge 15 is designed such that the lid 3 is, in open position of the closure 1, arranged by the value dZ at a lower level than the top deck 8 of the base 2. The mould separation plane, schematically indicated by line w, for the shown closures 1 is normally arranged in vertical direction (z-axis) on the level of the top deck 8 of the body 2. Due to the reason that the lid 3 is arranged at a by dZ lower level the mold separation plane may have a step in the region of the hinge 15.

The shown tamper evidence means/locking mechanism 40 of both closures 1 comprise at least one protruding tooth (counter locking means) 41 protruding above the outer surface of the lid 3. The tooth 41 is preferably arranged next to the mould separation plane w due to the reason that in general it offers a more simple mould design. The at least one tooth 41 engages while closing of the closure 1 with notch 47 which is part of a locking element 46 arranged here in general opposite to the hinge 15 on body 2. To disengage tooth 41 and notch 47 such that the lid 3 can be opened the front of lid 3 has to be pressed inwardly (in FIG. 24 indicated by PUSH) in the general direction of the centre axis of the closure.

Prior to first time opening of the closure as shown in FIG. 23 it is necessary to break of the tear off element/shackle 42 which is designed such that it engages with locking element 46 while first time closing of the closure 1, but is destroyed during initial opening of the closure 1. While the combination of flexible shackle 42 and rigid nose 46 serve as a mean for indicating initial opening of the closure the combination of tooth 41 and notch 47 may be used as lock which prevents unwanted opening, especially after initial opening. Due to the reason of the design of the tamper locking means 40 of the closure shown in FIG. 23 no slider in the mould is necessary, because no hindering undercut is formed. Thereby it is possible to make the tamper evidence means 40 at very low cost.

The closure 1 shown in FIG. 24 lacks the combination of shackle 57 and nose 58 as shown in FIG. 23. Instead it is necessary to tear off a tear of lip 59 by destroying breaking member 60, here having the form of a thin web unless it is possible to manually disengage tooth 41 and notch 47. To increase safety it is possible to combine additional locking/tamper evidence means. The shown closures may be suitable for carbonized beverages.

As it can be seen tooth 41, notch 47, shackle 57, nose 58 and tear of lip 59 are arranged outside the main contour of the body 2 and the lid 3. This offers the advantage that they are accessible in the mould in vertical direction (z-direction) such that sliders or shifting elements may be avoided.

The invention claimed is:

1. A closure comprising:

a body and a lid interconnected to each other by a hinge, wherein the body includes a main deck with a spout protruding above the main deck of the body, and tamper evidence means comprising:

a locking element arranged at the body and having a first and second locking rim the locking element suitable to be engaged from two opposite sides with a first and a second counter locking means interconnected to the lid of the closure, wherein the second counter locking means is interconnected removably by at least one frangible element to the lid and the first counter locking means comprises at least one tooth arranged on a wall area of the lid and protruding above the outer surface of the lid which wall area is radially inwardly deformable and in general opposite to the hinge, wherein to disengage the locking element, the second counter locking means is removed by breaking the at least one frangible element and the first counter locking means is disengaged by radially inwardly deformation of the wall area of the lid such that the second and first locking rim are released.

2. The closure according to claim 1, wherein the at least one frangible element comprises a thin web of material or a bridge.

3. The closure according to claim 1, wherein the at least one frangible element is arranged horizontally and/or vertically.

4. The closure according to claim 1, wherein the locking element has an in general bridge-like shape with a passage underneath, wherein a ceiling of the passage forms part of the first locking rim.

5. The closure according to claim 1, wherein the locking element has an in general T-like shape.

6. The closure according to claim 1, wherein the first and second counter locking means form a socket to receive the locking element.

7. The closure according to claim 1, wherein the counter locking means and the corresponding locking rims are arranged in general at the same or at a different level with respect to each other.

8. The closure according to claim 1, wherein the removable counter locking means is integrated in a tear off band.

9. The closure according to claim 8, wherein the tear off band is integrated in the outer contour of the closure.

10. The closure according to claim 8, wherein the tear off band is protruding over the outer contour of the closure.

11. The closure according to claim 1, wherein the hinge is a snap hinge assembly.

12. The closure according to claim 11, wherein the snap hinge assembly comprises two trapezoid elements each interconnected at two non-adjacent sides by a first and a second film hinge to the body and the lid of the closure.

13. The closure according to claim 12, wherein the trapezoid elements and the body and the lid are spaced apart by a gap.

14. The closure according to claim 1, wherein the tamper evidence means is arranged in general opposite to the hinge.

15. The closure according to claim 8, wherein the spout is a push-pull spout having a cap.

16. The closure according to claim 15, wherein the push-pull spout is in a closed position held closed by the lid.

17. The closure according to claim 6, wherein the locking element has the shape of a wedge in the area forming the first contact zone with the socket while initial closing.

* * * * *